US005126764A

United States Patent [19]

Miyauchi et al.

[11] Patent Number: 5,126,764

[45] Date of Patent: Jun. 30, 1992

[54] SHEET TRANSPORT UNIT FOR RECORDING SYSTEMS

[75] Inventors: Yasuo Miyauchi, Yokohama; Souhei Tanaka, Kawasaki, both of Japan

[73] Assignee: Canon Kabushiki Kaisha, Tokyo, Japan

[21] Appl. No.: 597,345

[22] Filed: Oct. 15, 1990

[30] Foreign Application Priority Data

Oct. 20, 1989 [JP] Japan ..... 1-273174

[51] Int. Cl.[5] ..... B41J 11/42

[52] U.S. Cl. ..... 346/138; 346/134; 346/140 R; 318/696; 318/685; 400/902

[58] Field of Search ..... 346/140 R, 134, 138, 346/; 318/696, 685, 62, 447, 474; 400/568, 902; 271/3, 256

[56] References Cited

U.S. PATENT DOCUMENTS 4,734,719 3/1988 Suzuki ..... 346/140 R
4,769,585 9/1988 Tanuma et al. ..... 318/696

FOREIGN PATENT DOCUMENTS 0251725 7/1988 European Pat. Off. .
57-203578 12/1982 Japan .
62-233273 10/1987 Japan .
62-286757 12/1987 Japan .

*Primary Examiner*—Benjamin R. Fuller
*Assistant Examiner*—Victor DeVito
*Attorney, Agent, or Firm*—Fitzpatrick, Cella, Harper & Scinto

[57] ABSTRACT

In a sheet transport unit for recording systems which uses a pulse motor to feed a recording sheet quantitatively and intermittently, multiple different current apply intervals are specified within the stop period during intermittent sheet feed, so that a maximum amount of current will be applied to the first interval immediately after the drive stops. Thereby, the pulse motor is never be damaged due to its temperature rise despite a load variation and the load variation can be absorbed enough to ensure high positioning accuracy.

3 Claims, 6 Drawing Sheets

SHEET TRANSPORT UNIT FOR RECORDING SYSTEMS

BACKGROUND OF THE INVENTION

This invention relates to a recording system which feeds a recording sheet intermittently by a given pitch using a pulse motor to thereby form images on it, more particularly to a pulse motor driving system used as a driving source for the recording sheet transport mechanism in the recording system.

RELATED BACKGROUND ART

The recording system for a printer, facsimile, or copying machine has such a configuration that the energy generating unit for imaging elements of a recording head is driven based on recording data to record images on paper, plastic sheets, or any other recording medium.

This type of recording system is usually of a print type to record one whole line, as a unit page print type to record one whole page, as a unit or of a serial type to record data while moving the carriage equipped with a recording head over a recording sheet, which then feeds the recording sheet by a given pitch when recording of one line completes to be ready for recording of the next line.

In the serial-type recording system or a recording system which feeds a recording sheet by a given pitch or amount and intermittently, the accuracy in recording sheet feed greatly affects image quality. Therefore, a pulse motor ensuring excellent positioning accuracy is generally employed as a driving source to transport (feed) recording sheets.

In addition, a member related to the sheet feed accuracy such as; a driving transfer means for sheet transport units or a feed roller which directly touches recording sheets to transport them, must permit high accuracy.

The pulse motor for sheet feed is often used not only to feed sheets but also to drive any load including a suction recovery pump located at the exit of an ink jet recording system.

However, if a mechanism which the sheet feed pulse motor drives in addition to sheet feed is prone to a great load variation, the load variation causes the pulse motor not to stop accurately and deviates the pulse motor from its specific stop position (angle). This causes such a critical technical problem as a sheet feed pitch error, thus deteriorating image quality.

To resolve that adverse effect of the load variation, the mechanism having a load variation should be driven by another driving source. Alternatively, a clutch is interposed between the sheet transport mechanism and the mechanism whose load varies. These measures require installation of an extra motor or an additional clutch, eventually increasing the cost or size of a system. The measures are, therefore, unfavorable.

In another method, a pulse motor is energized in its stop period which is in between two successive sheet feeding or advancing operations and in which no recording is effected during intermittent sheet feed in order to retain a holding torque, of the pulse motor whereby the pulse motor is used as a dedicated sheet feed pulse motor for recording systems (Japanese Laid-Open Patent Application No. 54-49026).

However, this kind of methods allows electric energy applied during the stop period of a pulse motor to be fully converted into heat energy. This accelerates temperature rise in the pulse motor and eventually causes a damage due to a burnout.

SUMMARY OF THE INVENTION

This invention aims to solve the aforementioned drawbacks, offering a sheet transport unit for recording systems to ensure high positioning accuracy despite a load variation.

The other purposes of this invention will be duly revealed through more specific embodiments mentioned later.

DESCRIPTION OF THE PREFERRED EMBODIMENTS

An embodiment of this invention is described below with reference to the drawings.

Figure 1:
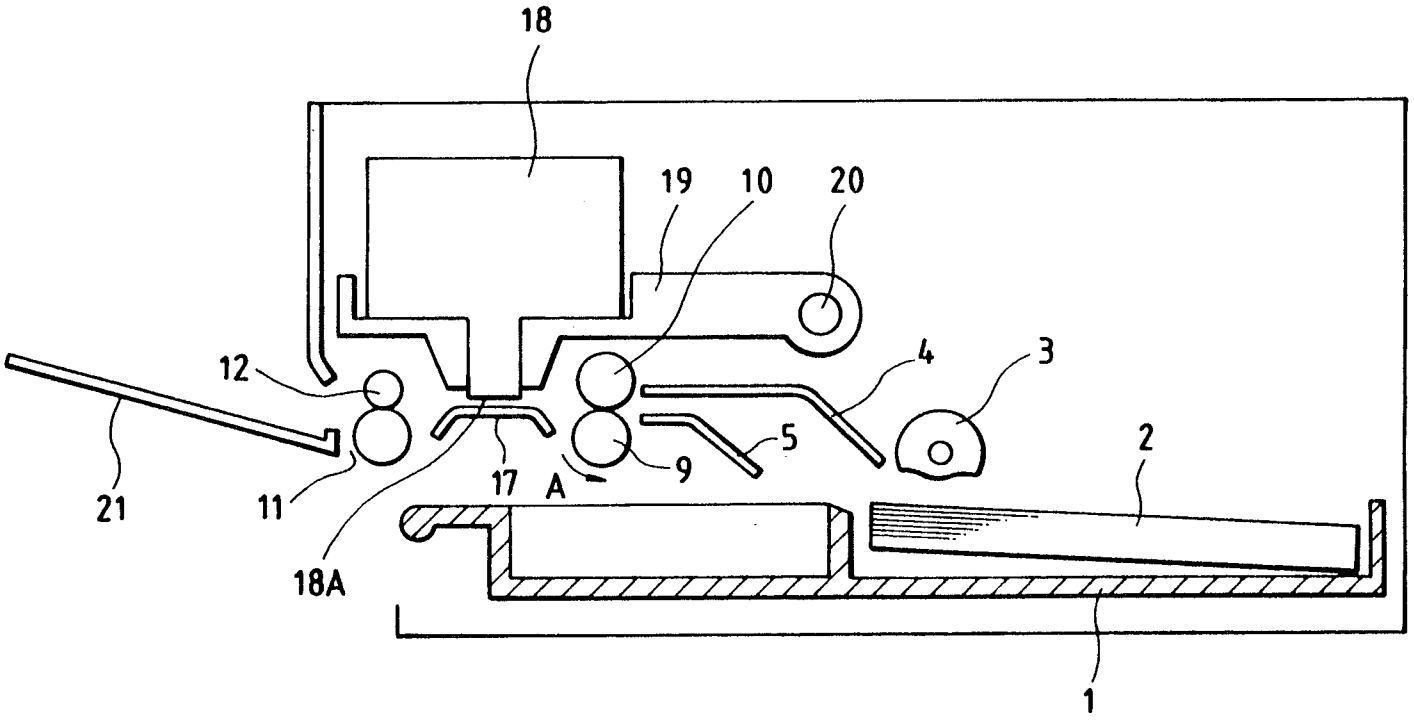
FIG. 1 shows a schematic longitudinal cross section demonstrating major sections of a recording system equipped with a sheet transport unit in which this invention is adopted.
Figure 2:
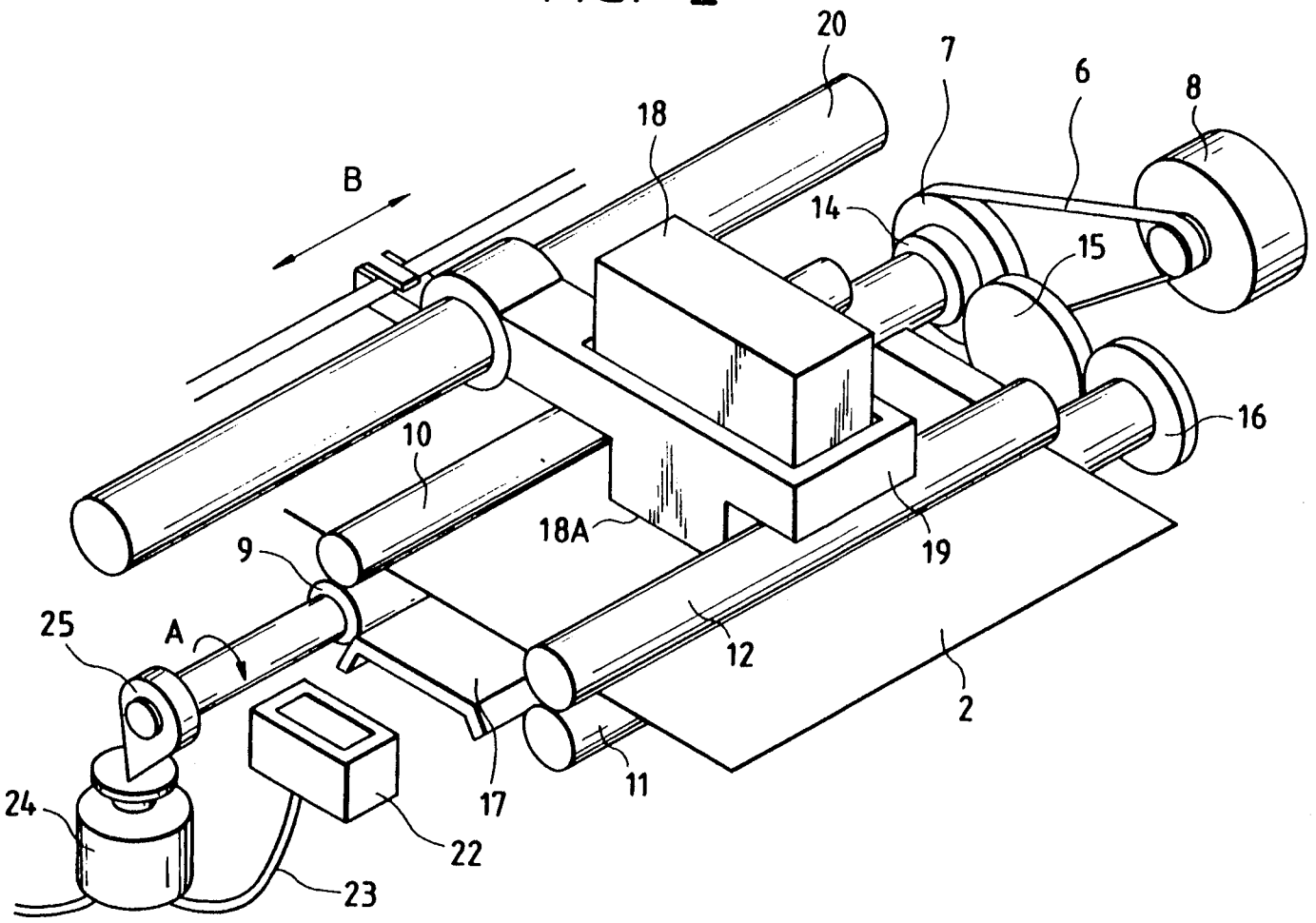
FIG. 2 shows a schematic oblique view demonstrating the major sections of the recording system in FIG. 1.

FIG. 1 shows a sheet transport system for recording systems. FIG. 2 shows a perspective view of the sheet transport system in FIG. 1.

In FIGS. 1 and 2, only a top sheet of recording sheets 2 (paper, thin plastic plate, or any other recording medium) loaded in a sheet feed cassette is picked up by rotating a sheet feed roller 3 and fed to the interspace between sheet feed guides 4 and 5.

The sheet feed roller 3 halts at the illustrated position after a single rotation. Then, transporting force for the recording sheet 2 quenches. At this time, the tip of the recording sheet 2 is sandwiched between a lower transport roller 9 which a pulse motor 8 drives and an upper transport roller 10 which is pressed toward the lower transport roller and follows the rotation thereof. Thereafter, recording sheet 2 is restricted in its feed pitch by a pair of these rollers 9 and 10.

The lower transport roller 9 is driven by the pulse motor 8 via a belt 6 and a pulley 7.

The recording sheet 2 is further fed and then stopped when its tip is caught between a lower sheet discharge roller 11 and an upper sheet discharge roller 12.

The upper sheet discharge roller 12 is held down to the lower sheet discharge roller 11 by means of a spring unshown.

Here, the lower sheet discharge roller 11 is coupled with the lower transport roller 9 via gears 14, 15, and 16. The lower sheet discharge roller 11 is set to rotate faster than the lower transport roller 9 by a given percentage (for example, 2%).

Thus setting the rotation speed, the recording sheet 2 always remains properly tensioned at a platen 17.

In this state, a carriage 19 having a recording head 18 scans along a rail 20 in arrow B direction, whereby recording for a single line is performed.

When recording of a single line completes, the transport roller 9 is rotated in arrow A direction so that the recording sheet 2 will be fed by a given pitch to be ready for recording of the next line. This series of operations is repeated.

When recording of the entire recording sheet 2 completes, the recording sheet 2 is discharged onto a sheet discharge tray 21 by a pair of sheet discharge rollers 11 and 12.

In the meantime, an ink exit of the recording head 18 may clog and fail to supply ink for some portions. This clogging can be recovered (cleared) by a suction recovery mechanism. To be more specific, an exit surface 18A of the recording head 18 is sealed with a cap 22. Then, a pump 24 is used to suck inside of the cap 22 via a tube 23. Thus, clogging of each exit is cleared (recovered). This is the suction recovery mechanism.

The suction pump 24 is driven when pushed by a cam 25 fixed at the end of the lower transport roller 9.

Thereby, a load torque applied to the pulse motor 8 greatly varies depending on whether the cam 25 is pushing the pump 24 or not.

With this invention, in a sheet transport unit for a recording system adopting a pulse motor 8 for feeding a recording sheet 2 intermittently, by a given amount each time, multiple different current apply intervals are specified within the stop duration which is in between two successive sheet feedings of the intermittent sheet feed and in which no recording is effected so that a maximum amount of current will be applied to the same phase as that in which the motor drive stops during the first interval immediately after the motor drive stops. Thereby, even if a load to the pulse motor 8 varies with on or off of the pump 24, temperature rise in the pulse motor 8 can be suppressed and the load variation can be absorbed. Thus, high positioning accuracy can be ensured despite a load variation.

In a typical embodiment of this invention, when the pulse motor 8 stops during intermittent and a given pitch or amount of feed of a recording sheet 2 or when the pulse motor stops after the recording sheet 2 is fed by a given pitch at a time of line feed, a given amount of current is applied to the same phase as that in which the motor drive stops during a given period of time immediately after the drive stops. This helps increase in a holding torque of the pulse motor 8. Thereby, the pulse motor 8 always stops rotating at the same position.

Moreover, after a given time has elapsed within the stop period of the pulse motor 8, or after rotation of the pulse motor has stopped and oscillation of a transport roller 9 or any other inertial load has attenuated, current is disconnected. This successfully prevents such a fault that the pulse motor 8 itself is heated up and eventually broken due to the temperature rise.

Figure 3:
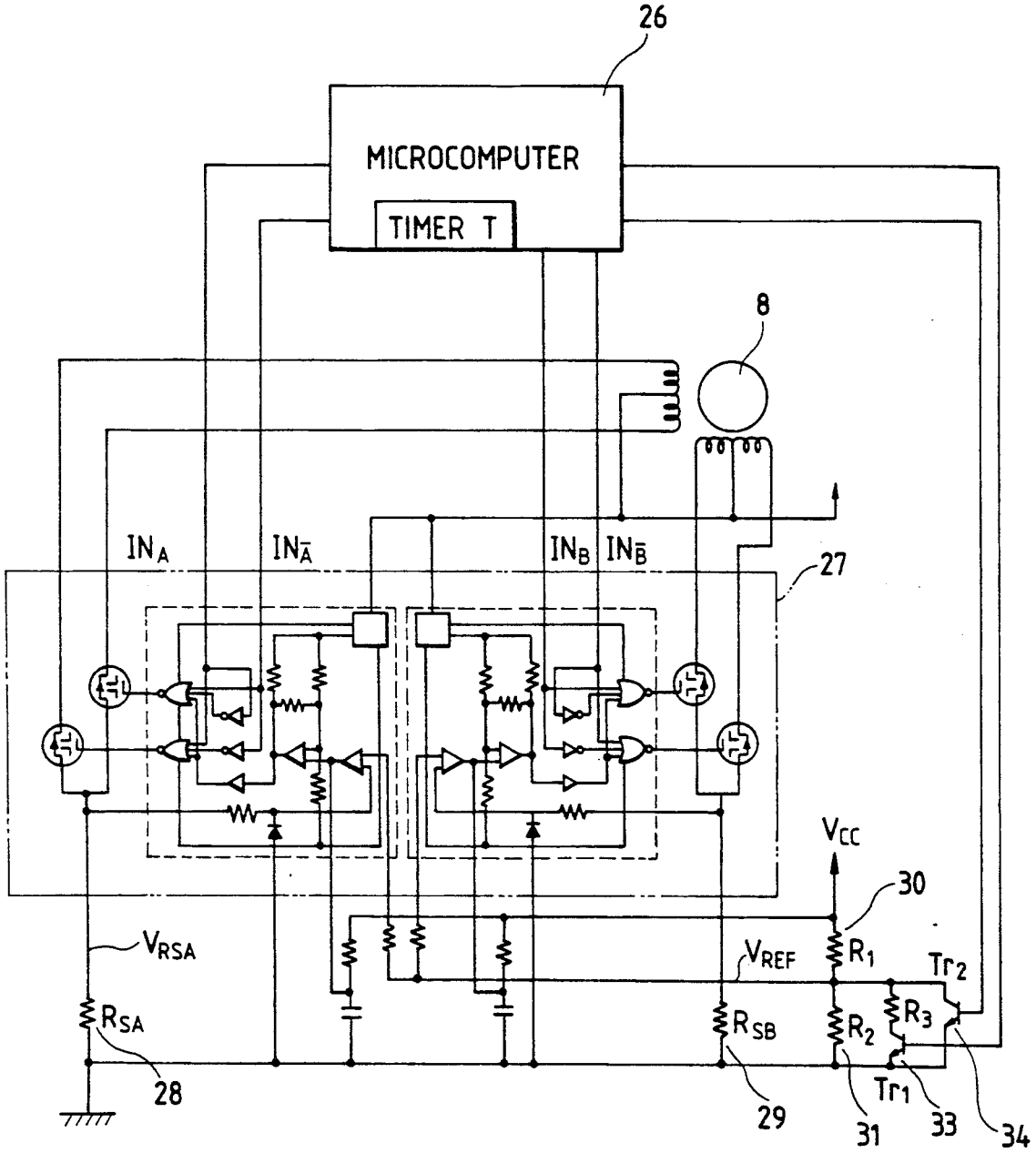
FIG. 3 is a pulse motor rotation control circuit diagram for the recording system shown in FIG. 1.

FIG. 3 shows a circuit to control rotation of the above pulse motor 8.

In FIG. 3, 26 represents a microcomputer to control rotation or stoppage, rotation rate, rotation speed, and driving current for the pulse motor 8. The microcomputer 26 incorporates a timer T and outputs control signals to a pulse motor driving IC 27 as well as driving current control elements (Tr1 and Tr2) 33 and 34.

The pulse motor driving IC 27 detects currents flowing phases A, $\overline{A}$, B, and $\overline{B}$ of the pulse motor 8 using voltages across current detecting resistors $R_{SA}$ and $R_{SB}$) 28 and 29. Then, the currents flow until the voltages become equal to comparison voltage $V_{REF}$ generated through voltage dividing resistors (R1 and R2) 30 and 31. Thus, chopping is done to control constant current.

The SLA7024M of Sanken Electric Co., Ltd. may be used as the pulse motor driving IC 27.

The comparison voltage $V_{REF}$ varies with on's or off's of driving current control elements (Tr1 and Tr2) 33 and 34 according to the following expressions: When both Tr1 and Tr2 are off;

$$V_{REF} = \frac{R_2}{R_1 + R_2} V_{CC} \quad (1)$$

When Tr1 is on and Tr2 is off;

$$V_{REF} \simeq \frac{R_2/R_3}{R_1 + R_2/R_3} V_{CC} \quad (2)$$

When Tr1 is off and Tr2 is on;

$$V_{REF} \simeq 0$$

Under the control of the comparison voltages given by the above expression (1), (2), and (3), the driving currents (1), (2), and (3) get smaller in that order. That current values are changeable.

Figure 4:
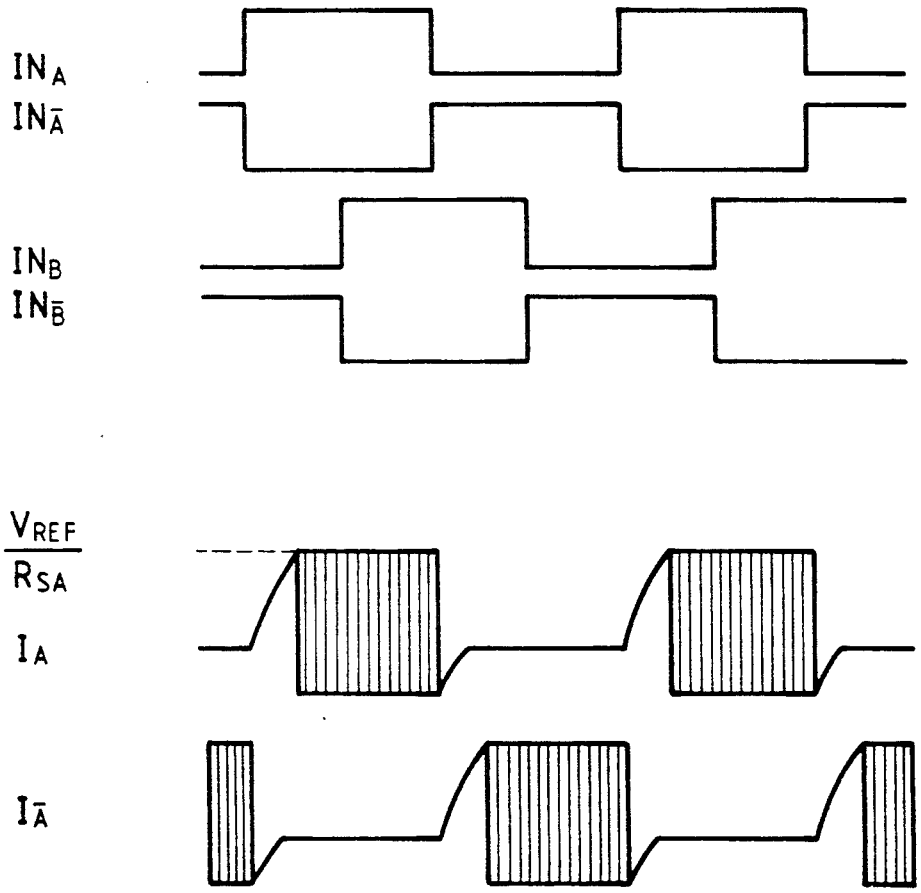
FIG. 4 is graphs indicating the pulse motor control signals and the current waveforms of each phase of the pulse motor shown in FIG. 3.

FIG. 4 shows the waveforms of signals INA, IN$\overline{A}$, INB, and IN$\overline{B}$ sent from the microcomputer 26 to the pulse motor driving IC 27. The waveforms of the currents flowing through the phases of the pulse motor 8 (for two-phase exciting mode) are also shown graphically.

Figure 5A:
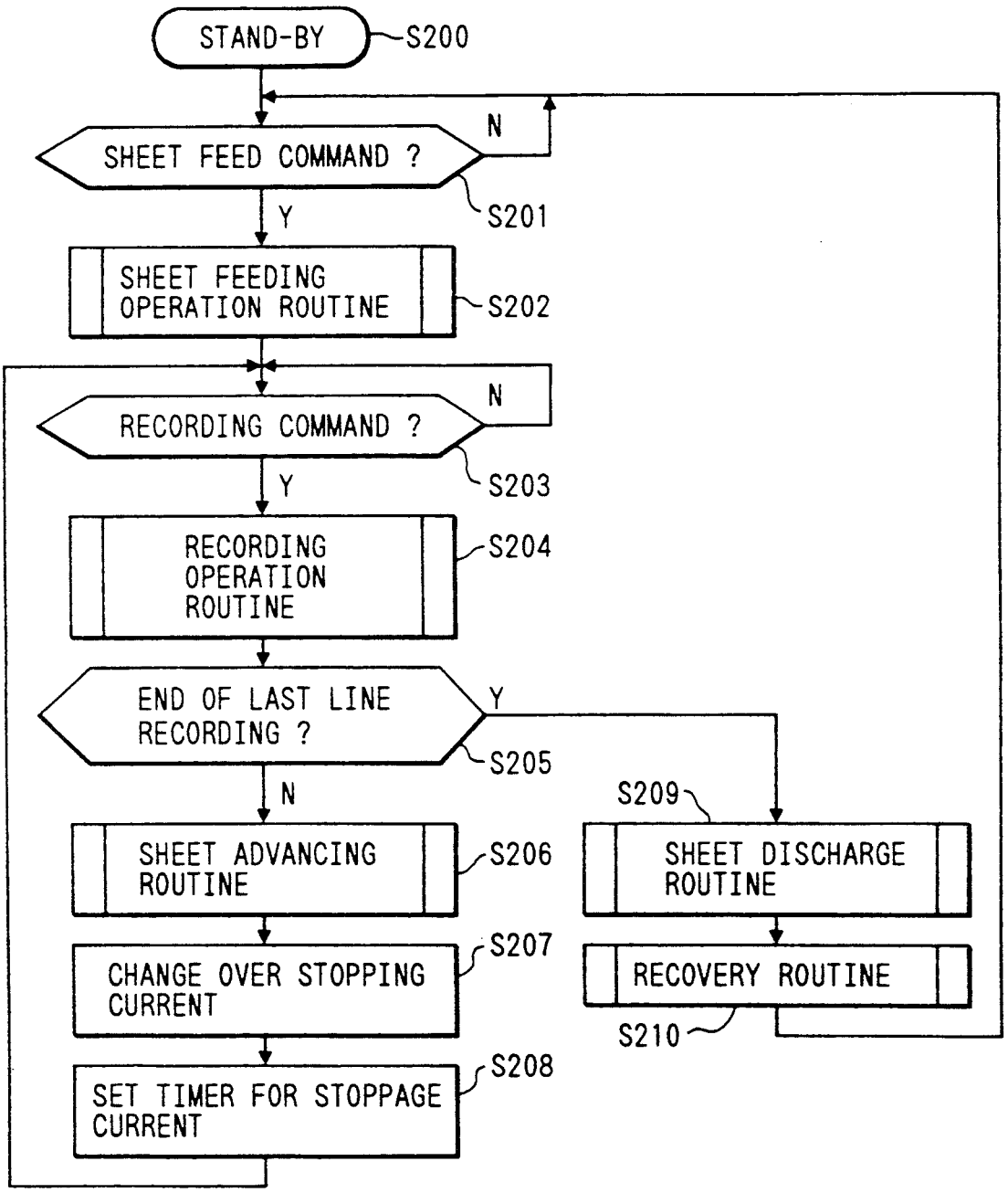
FIGS. 5A and 5B are flowcharts representing operations of a sheet transport unit in which this invention is adopted.
Figure 5B:
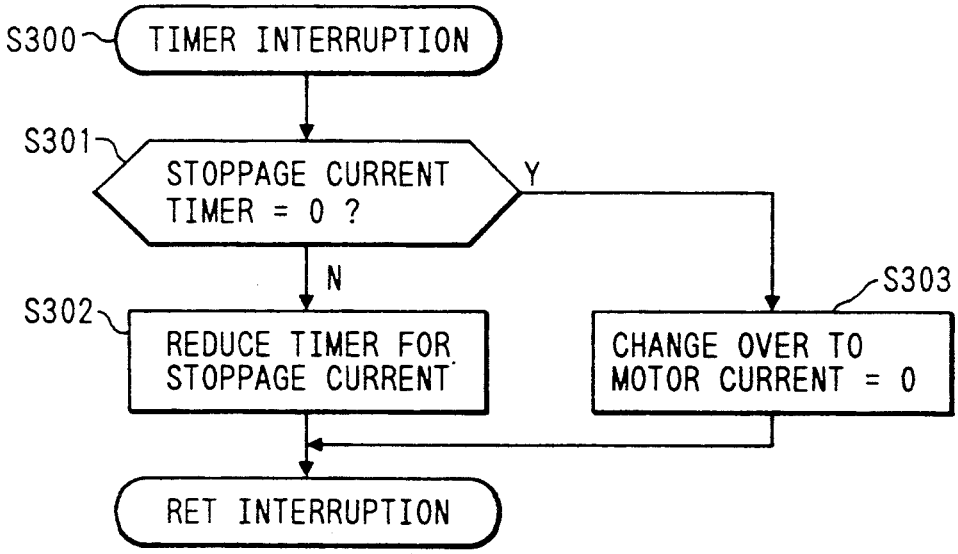

FIGS. 5A and 5B are flowcharts demonstrating sheet feed control operations by the microcomputer 26.

In FIG. 5A, the system enters a stand-by routine at a step S200. Upon receipt of a sheet feed command at a step S201, it rotates the pulse motor 8 to feed sheets at a step S202.

With a recording command for one line received at a step S203, the system proceeds to a step S204, and then rotates a carriage motor unshown and drives a recording head 18 to record data.

At a step S205, it is determined whether the recording operation is to be performed on the last line. If it is not on the last line, the system proceeds to a step S206. Thereby, the pulse motor 8 is rotated for a single line to feed a recording sheet 2 for recording of a single line.

A driving current control element Tr1 is set to on at a step S207 to change the stoppage current, so that a certain torque will be applied (a given holding torque will be generated) immediately after the pulse motor 8 is stopped after completing sheet feed. The stoppage current at this time is provided to the same phase as that in which the motor drive has stopped.

In addition, at a step S208, a stoppage current timer T is set so that the stoppage current will flow for a certain duration within the stop period of the pulse motor 8.

Thereafter, the system returns to the step S203 and determines if the next recording command is found. If it is found, the above operations are repeated.

FIG. 5B shows an interruption routine 300 performed at intervals of a certain duration for the stoppage current timer T.

In FIG. 5B, the stoppage current timer T set as previously mentioned checks at the step S301 if the timer value becomes nil and reduces the value at a step S302 until it becomes nil. When the value becomes nil, the driving current control element Tr2 is set to on at a step S303 so that pulse motor current will be nil.

In FIG. 5A, when it is confirmed at a step S205 that recording of the last line has completed, the system proceeds to a step S209 and rotates the pulse motor 8 by a given pitch to discharge a sheet. Then, the system proceeds to a step S210 for a recovery routine. Then it returns to the step S201 and waits for the next sheet feed and recording commands.

According to the embodiment described above, when the pulse motor 8 which feeds a recording sheet 2 a given pitch or amount and intermittently stops during intermittent sheet feed, multiple different current applying intervals are specified so that a given amount of current will be applied during the first interval immediately after the drive stops. Even if a load to the pulse motor 8 varies due to on or off of an ink recovery unit for which the motor also works, the load variation can be absorbed without damaging to the pulse motor 8 due to the temperature rise. This has embodied a sheet transport unit which ensures high positioning accuracy even if a load variation occurs.

In the above embodiment, this invention is adopted in a sheet transport unit for bubble-set type ink jet recording systems. Herein, the bubble-set type ink jet recording system is an ink jet recording system in which heating elements are installed along a recording fluid path within a recording head 18 to bring about a state change in the recording fluid or create bubbles in the recording fluid using heat energy, whereby fluid drops produced with pressure of the bubbles are fused on recording sheets for recording. This invention is also applicable to the sheet transport unit for an ink jet recording system using electromechanical energy conversion elements, thermal recording system, wire-dot type recording system, laser-beam type recording system or any other recording system using any type of recording head.

In the above embodiment, the stop period of the pulse motor 8 which is between two successive sheet feeding operations is divided into two intervals, namely; current apply and non-apply intervals. In the later current non-apply interval, current should not necessarily be made nil. That is, a very small amount of current may flow in such a way that the temperature of the pulse motor 8 will not be a hindrance.

In another embodiment, the aforementioned stop period is divided into three or more intervals. Then, a maximum amount of current is applied during the interval immediately after the pulse motor stops and then the current is reduced gradually in the subsequent intervals. This method is also feasible and has proved equally effective.

As the above description has clarified, this invention yields the following advantages: In a sheet transport unit for recording systems which uses a pulse motor to feed a recording sheet by a given pitch or amount each time intermittently, multiple different current applying intervals are specified within the stop period during intermittent sheet feed so that a maximum amount of current will be applied during the first interval immediately after the drive stops. Thereby, even a unit including a factor of great load variation can ensure satisfactory accuracy in quantitative feed of a recording sheet and permit excellent image quality. In addition, since current is disconnected after the drive stops completely, temperature rise in a pulse motor is subdued in a practical level. This prevents a burnout or any other fault due to the temperature rise.

What is claimed is:

1. A sheet transport unit for recording systems, comprising:

sheet transport means for feeding a recording sheet intermittently by a certain amount each time, said sheet transport means having a sheet transport roller;

a recording head for recording data on said recording sheet, said head having an ink exit for recording;

suction recovery means for clearing clogging at said ink exit of the recording head, said suction recovery means having a suction pump to perform suction recovery;

operating means for activating said suction pump, said operating means being actuated at every predetermined angle of rotation of said sheet transport roller to activate said suction pump;

a pulse motor for driving said sheet transport means, having a load the load of said pulse motor varies depending on whether the pulse motor is activating said operating means; and drive control means for controlling said pulse motor, said drive control means energizing said pulse motor for a given duration within a stop period in which no sheet feeding is effected between two successive sheet feedings during intermittent sheet feed by said sheet transport means immediately after said pulse motor drive stops, and thus increasing a holding torque of the pulse motor.

2. A sheet transport unit according to claim 1, wherein said drive control means comprises a timer for energizing said motor for a given duration immediately after the motor drive stops, said timer deenergizing the motor after oscillation of any member of said sheet transport unit having inertia has attenuated.

3. A sheet transport unit according to claim 1, wherein said operating means is equipped with a cam to activate a suction pump at every predetermined angle of rotation of said transport roller.

* * * * *

UNITED STATES PATENT AND TRADEMARK OFFICE

CERTIFICATE OF CORRECTION

PATENT NO. : 5,126,764

DATED : June 30, 1992

INVENTOR(S) : Miyauchi et al.

It is certified that error appears in the above-identified patent and that said Letters Patent is hereby corrected as shown below:

[57] ABSTRACT:

Line 9, "be" should be deleted.

COLUMN 1:

Line 20, change "a print" to --a line print--.
Line 21, change "a unit page" to --a unit, a page--.
Line 36, change "as;" to --as:--.
Line 51, change "resolve" to --solve--.

COLUMN 3:

Line 29, change "current apply intervals" to --current supply intervals--.
Line 32, change "effected" to --effected,--.

COLUMN 4:

Line 10, change "off;" to --off:--.
Line 15, change "off;" to --off:--.
Line 21, change "on;" to --on:--.

COLUMN 5:

Line 25, change "bubble-set" to --bubble-jet--.
Line 26, change "bubble-set" to --bubble-jet--.

UNITED STATES PATENT AND TRADEMARK OFFICE

CERTIFICATE OF CORRECTION

PATENT NO. : 5,126,764

DATED : June 30, 1992

INVENTOR(S) : Miyauchi et al.

It is certified that error appears in the above-identified patent and that said Letters Patent is hereby corrected as shown below:

COLUMN 6:

Line 34, change "having a load" to --having a load,--.

Signed and Sealed this

Ninth Day of November, 1993

*Attest:*

*Attesting Officer*

BRUCE LEHMAN

*Commissioner of Patents and Trademarks*